US006386519B1

(12) United States Patent
Priefert

(10) Patent No.: US 6,386,519 B1
(45) Date of Patent: May 14, 2002

(54) CONTINUOUS POST AND RAIL FENCE

(75) Inventor: William D. Priefert, Mt. Pleasant, TX (US)

(73) Assignee: Priefert Manufacturing Co., Inc., Mt. Pleasant, TX (US)

( * ) Notice: Subject to any disclaimer, the term of this patent is extended or adjusted under 35 U.S.C. 154(b) by 0 days.

(21) Appl. No.: 09/384,919

(22) Filed: Aug. 27, 1999

(51) Int. Cl.[7] ..... E04H 17/14
(52) U.S. Cl. ..... 256/68; 256/1
(58) Field of Search ..... 256/68, 69, 67, 256/54, 1, 65; 403/289

(56) References Cited

U.S. PATENT DOCUMENTS

| | | | | | |
|---|---|---|---|---|---|
| 1,631,831 | A | * | 6/1927 | Palmer-Jones | 256/65 |
| 3,522,960 | A | * | 8/1970 | Moore | 287/54 |
| 3,524,627 | A | * | 8/1970 | Boyanton et al. | 256/65 |
| 3,535,751 | A | * | 10/1970 | Batchelor | 24/263 |
| 3,604,687 | A | * | 9/1971 | Moore | 256/65 |
| 3,960,367 | A | * | 6/1976 | Rogers | 256/21 |
| 4,078,772 | A | * | 3/1978 | Carbone | 256/24 |
| 4,208,038 | A | * | 6/1980 | Reid | 256/65 |
| 4,899,991 | A | * | 2/1990 | Brunken | 256/69 |
| 5,297,890 | A | * | 3/1994 | Commins | 403/398 |
| 5,657,968 | A | * | 8/1997 | Marsden | 256/65 |
| 5,857,664 | A | | 1/1999 | Schauman | |
| 5,961,242 | A | * | 10/1999 | Leone | 403/234 |

* cited by examiner

*Primary Examiner*—Lynne H. Browne
*Assistant Examiner*—John B. Walsh
(74) *Attorney, Agent, or Firm*—Kent A. Herink; Daniel A. Rosenberg

(57) ABSTRACT

The present invention comprises a post and rail fence comprised of a plurality of posts, rails, and clamps. The posts rigidly engage with the ground in a generally perpendicular fashion, at spaced apart intervals. The clamps interconnect the rails and the posts, through interconnected post clamp and rail clamp sections. The clamp interconnection is accomplished with a tensioning member that provides a variable clamping force and maintains the connection between the posts and the rails.

12 Claims, 5 Drawing Sheets

CONTINUOUS POST AND RAIL FENCE

BACKGROUND OF THE INVENTION

The present invention relates to a continuous post and rail fence, and in particular to a post and rail fence comprised of a plurality of posts and rails interconnected with a clamp comprised of a post clamp, a rail clamp, and an interconnecting tensioning member.

While post and rail fences are common and have the advantage of durability and pleasing appearance, they suffer from a number of drawbacks. Many of the fences are welded in place, which comprises a labor intensive and expensive method of constructing fences. High quality professional welders are hard to find, and expensive to hire.

Further, the materials used for traditional post and rail fences includes heavy pipe, often used and discarded. The old pipe frequently exhibits rusting and pitting, which makes the surface difficult to clean and paint. This results in an unprofessional looking fence, that requires frequent re-painting to maintain a satisfactory appearance. Even with the best of materials pipe and rail fences will require frequent painting over the years.

The highly rigid nature of welded in place pipe and rail fences makes them costly to repair if damaged. For example, a fence near a roadway struck by a vehicle may require complete replacement. Due to the rigid nature of the fence, after an impact every post in the fence has been pulled crooked or is knocked out of alignment. Additionally, the welded joints make replacement of portions of modules of the fence difficult, if not impossible.

Thus, a need exists for a post and rail fence that is easier to install and repair, and still provides the longevity and pleasing appearance of traditional fences.

SUMMARY OF THE INVENTION

An object of the present invention comprises providing a post and rail fence that is easy to assemble and maintain.

These and other objects of the present invention will become apparent to those skilled in the art upon reference to the following specification, drawings, and claims.

The present invention intends to overcome the difficulties encountered heretofore. To that end, the present invention comprises a post and rail fence comprised of a plurality of posts, rails, and clamps. The posts rigidly engage with the ground in a generally perpendicular fashion, at spaced apart intervals. The clamps interconnect the rails and the posts, through interconnected post clamp and rail clamp sections. The clamp interconnection is accomplished with a tensioning member that provides a variable clamping force and maintains the connection between the posts and the rails.

DETAILED DESCRIPTION OF THE INVENTION

Figure 1:
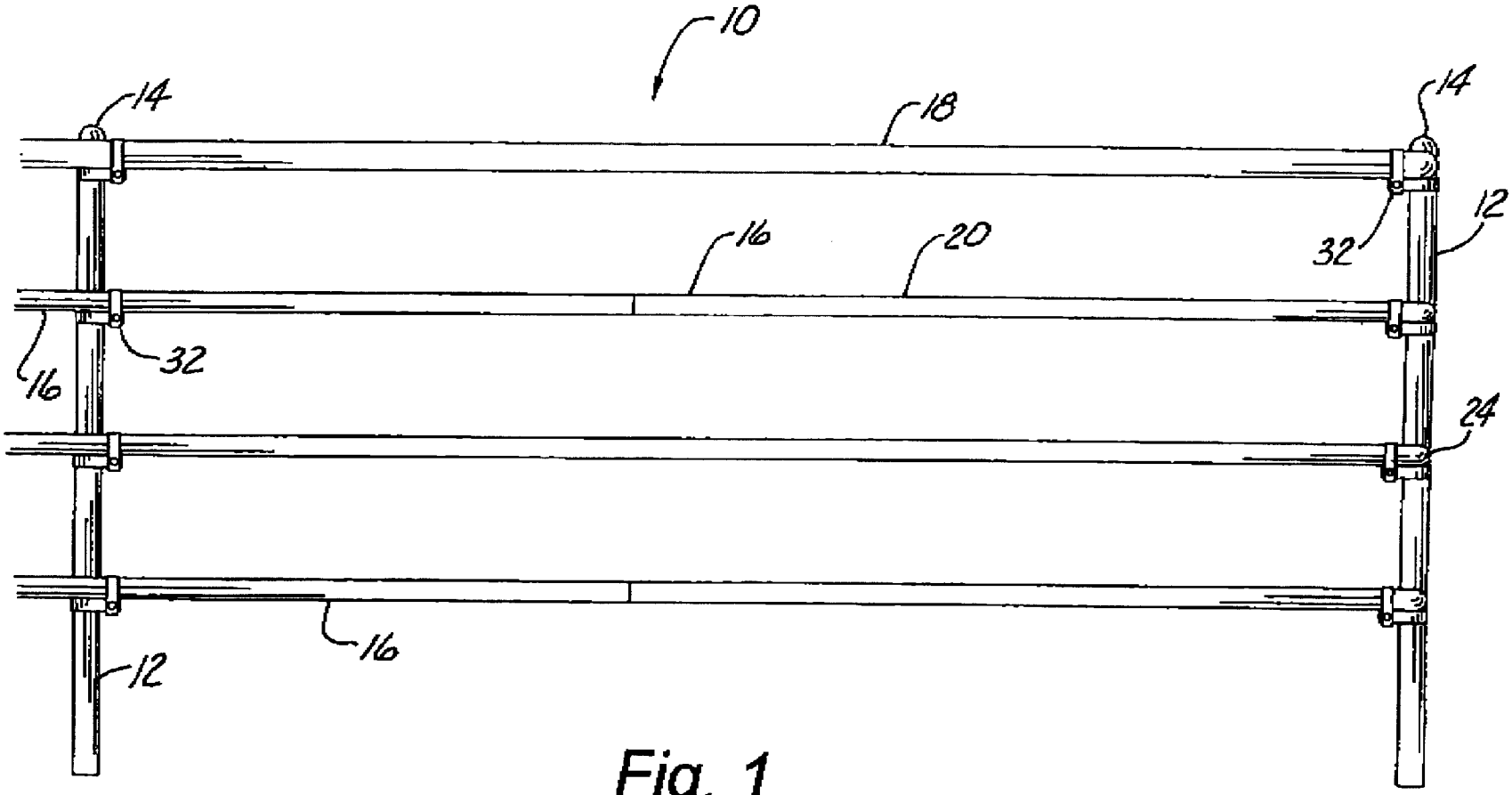
FIG. 1 shows a side elevation view of an assembled post and rail fence.

In the figures, FIG. 1 shows a continuous post and rail fence 10. The fence 10 is comprised of a plurality of posts 12 spaced apart at convenient intervals from each other, and rigidly engaged with the ground in a traditional manner. For example, the post 12 can be set in concrete or similar material that will maintain the post 12 in a generally perpendicular orientation to the ground. The fence 10 also comprises a plurality of rails 16 that interconnect to form one or more generally parallel rows such that the rows are substantially perpendicular to the post 12. A plurality of clamps 32 secure the rails 16 to the post 12.

Figure 2:
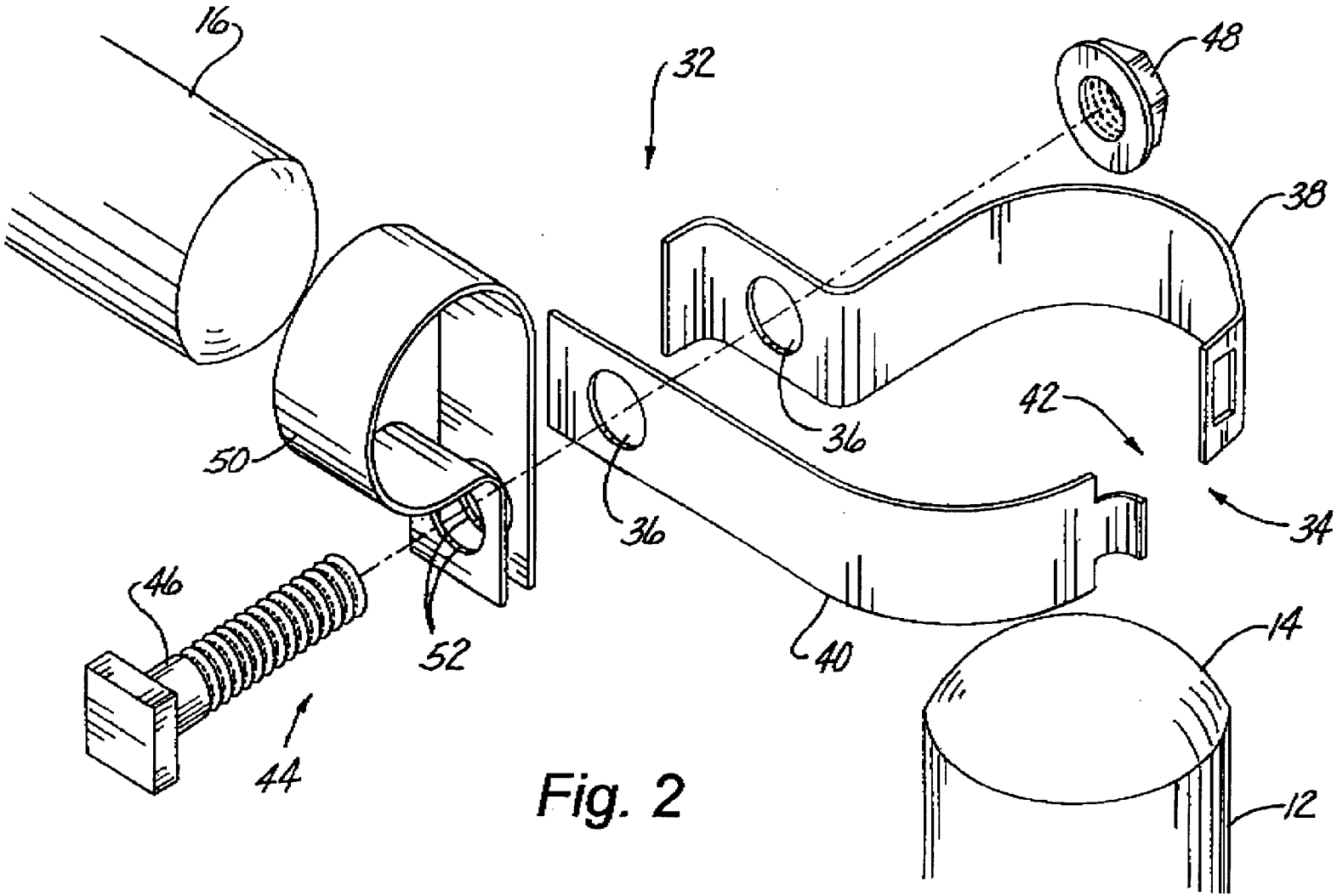
FIG. 2 shows an exploded view of the post and rail connection, and clamp.

FIG. 2 shows best the orientation of the post 12, rail 16, and clamps 32. The clamps 32 comprise a post clamp section 34 for attachment or clamping to the posts 12, and a rail clamp section 50 for clamping to the rails 16. Additionally, a tensioning member 44 interconnects the post clamp section 34 and the rail clamp section 50 and provides for the application of a variable clamping force to maintain the interconnection between the posts 12 and the rails 16.

In particular, the rail clamp 50 comprises a metal strap formed to fit around an outside of the rails 16. In the preferred embodiment, shown in FIG. 2, the-rail clamp 50 includes a rounded portion and a straight edge portion wherein the straight edge portion includes rail clamp holes 52. In a similar manner, the post clamp 34 of the clamp 32 comprises a generally circular two piece metal strap formed to fit around an outside of the posts 12. In the preferred embodiment, the post clamp 34 comprises a multi-piece clamp with a first piece 38 and a second piece 40. On one end, both the first piece 38 and the second piece 40 include post clamp holes 36. And the other end, the first piece 38 and the second piece 40 include a post clamp hinge 42. In this manner, the first piece 38 and the second piece 40 of the post clamp 34 can be assembled around the outside of the post 12.

Post clamp hinge 42 consists of a releasable connection formed by a female portion of the first piece 38, which can receive a male portion of the second piece 40. The hinge allows for the construction of the post clamp 34 out of a heavier gauge steel, which in turn enhances the ability of the clamp 34 to grip the posts 12 to prevent slipping. A one piece clamp would need to be constructed of a material flexible enough to open the clamp to fit around the posts 12, and then closed to bring the post clamp holes 36 into alignment with each other. This manipulation needs to take place in the field by hand, thus requiring the use of a lighter gauge material with less gripping ability. Another advantage of a two piece post clamp 34 comprises the fact that additional rows of rails 16 can be added to the fence 10 without removing any existing rows of rails 16.

The tensioning member 44 interconnects the post clamp 34 and the rail clamp 50 to each other and provides the tension to hold the rails 16 to the posts 12. In the preferred embodiment of the invention, the tensioning member 44 consists of a threaded bolt 46 and nut 48. The threaded bolt 46 passes through the rail clamp holes 52 and the post clamp holes 36. Fitting the nut 48 to the threaded bolt 46 allows for adjustably tensioning the clamping force that secures the posts 12 to the rail 16. Also, the interconnection between the post clamp 34 and rail clamp 50 allows the clamps 34, 50 to pivot relative to each other. In addition to allowing for easy installation, the pivoting connection allows the rails 16 to freely follow the contour of the land while the posts 12 can remain plumb.

Figure 6B:
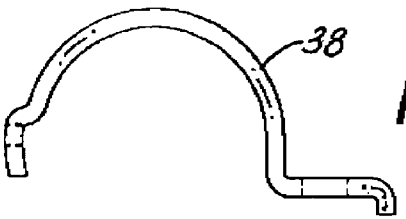
FIG. 6*b* shows a side elevation view of a first piece of a post clamp.
Figure 6C:
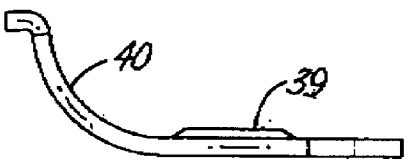
FIG. 6*c* shows a side elevation view of a second piece of the post clamp.
Figure 6A:
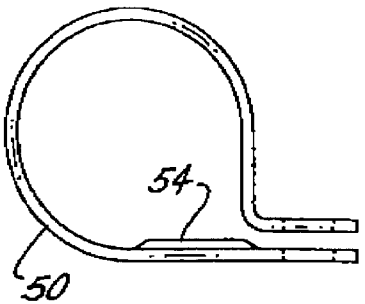
FIG. 6*a* shows a side elevation view of a rail clamp.

Additionally, in order to enhance further the ability of the clamps 32 to interconnect the posts 12 and the rails 16, FIGS. 6*a–c* show that the post clamp 34 and the rail clamp 50 include ridges 54, 39. FIG. 6*a* shows the ridge 54 in the rail clamp 50. The ridge 54 provides a raised surface for gripping the rail 16. In a similar fashion, FIG. 6*c* shows that the second piece 40 of the post clamp 34 contains ridge 39 that creates a raised surface to engage with the post 12. Further, the ridges 54, 39 stiffen the straightened ends of the clamps 34, 50 to strengthen the clamps 34, 50 for the application of more "wrap-pull" around the rails 16 and posts 12.

Figures 3A, 3B, 3C:
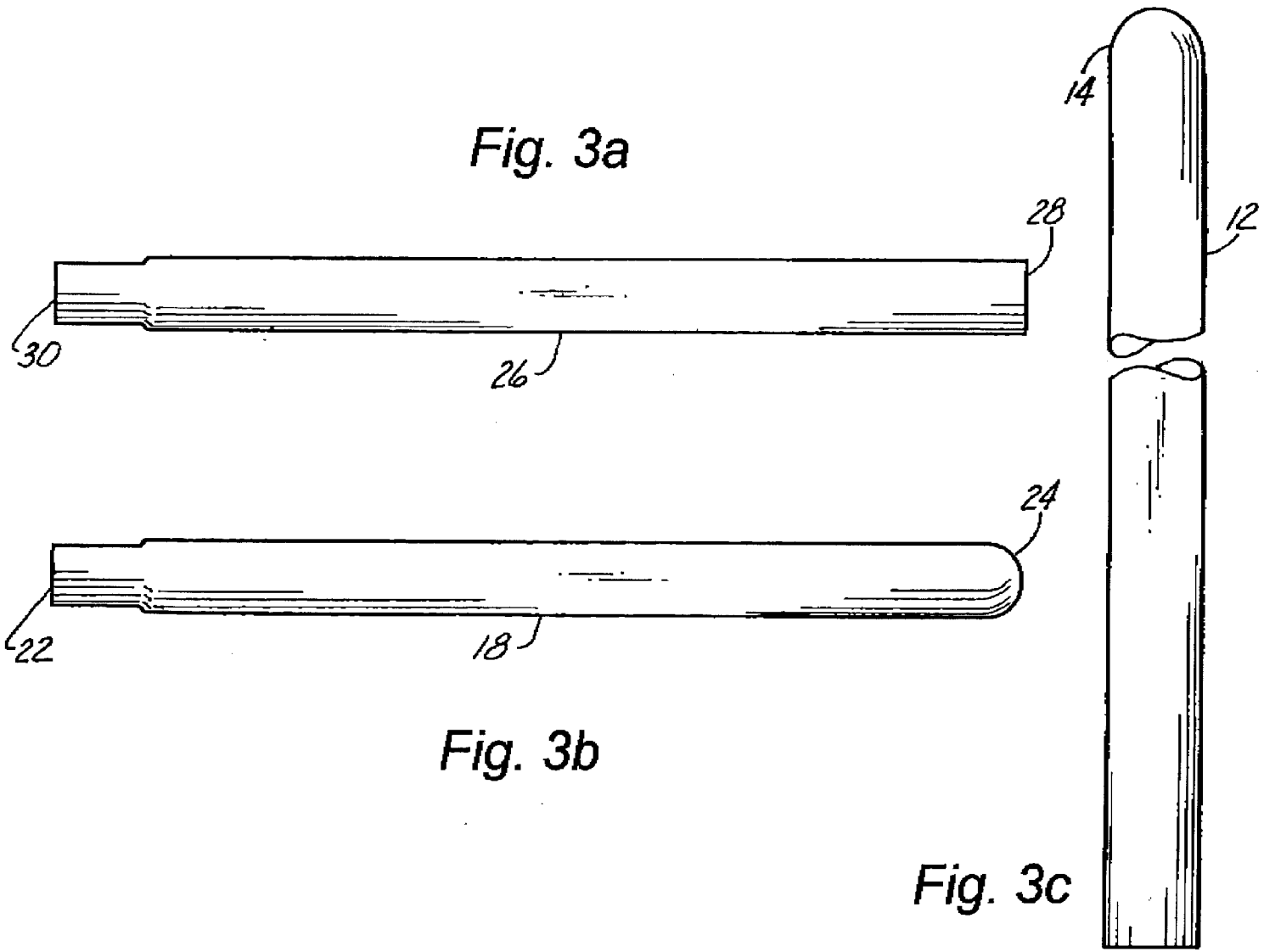
FIG. 3*a* shows a side elevation view of an open rail.
FIG. 3*b* shows a side elevation view of a end rail.
FIG. 3*c* shows a side elevation view of a post.

FIG. 3*a* and FIG. 3*b* show two types of rails 16. FIG. 3*a* shows an open rail 26 which includes an open end 28, and a reduced diameter end 30. The reduced diameter end 30 is designed for receipt within the open end 28 of an adjacent rail 16. This provides the capability of a swedged interconnection between the rails 16. FIG. 3*b* shows that the end rail 18 comprises an open end 22 and a closed rounded end 24. The rounded end 24 results from hot spin forming the rail 18, which creates a sealed dome shape on one end. In a similar fashion, FIG. 3*c* shows that the post 12 also includes a rounded post cap 14 formed in the same fashion. The advantage of the one-piece rounded ends comprises the fact that this eliminates the need to add separate end caps. End caps can be difficult to install, can loosen, fall off, or otherwise complicate installation and maintenance of the fence.

Figure 4:
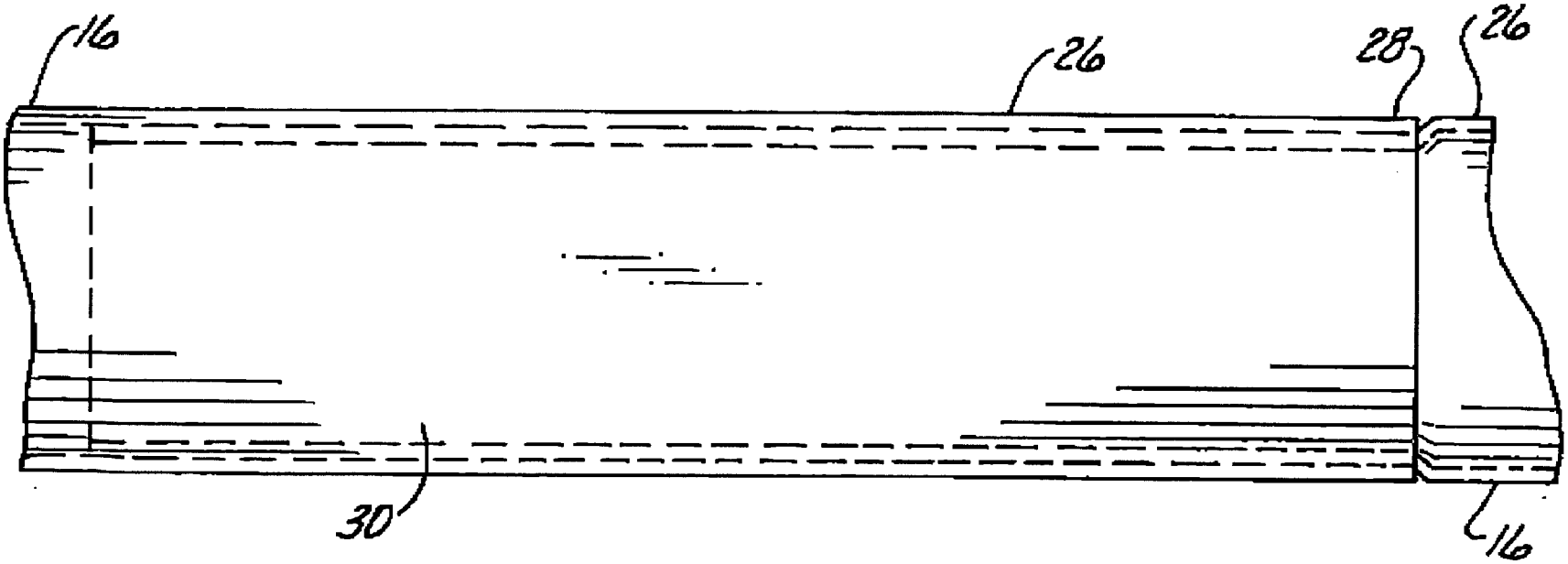
FIG. 4 shows the interconnection of two open rails.

FIG. 4 shows the interconnection of the rails 16 in greater detail. In particular, the reduced diameter end 30 of one rail 16 fits within the open end 28 of an adjacent rail 16 in a way that creates an inside swedged fitting that maintains a ridged connection.

The following describes the method of installing the fence 10 of the present invention. Installation begins with setting the posts 12 in the ground at a desired spacing and height. The spacing can vary depending on the application. For example, 6' post spacing works well for corrals, while 8 to 10' spacing works well with standard pasture fencing. After setting the posts 12 and assuring that the posts 12 are vertically plumb, the next step begins with assembling the rails 16. This begins by setting the end rails 18, 20. FIG. 1 shows that the end rails come in a first length 18 and a second length 20. This provides for staggering the interconnection point between the end rails 18, 20 and the open rails 26. In the preferred embodiment, shown in FIG. 1, the top rail starts with a 12' end rail 18 with the rounded end 24 positioned at a corner. The next row of the fence begins with an end rail 20 approximately half the length of the rail 18. Again, the rounded end 24 of the rail 20 is oriented next to a corner post 12. Next, the open rails 45 26 are assembled by positioning them through the appropriate rail clamp 50 and then interconnecting the open rail 26 with an adjacent rail 16, such that the open end 28 interconnects with a reduced diameter end 30.

The clamps 32 assemble essentially in the manner shown in FIG. 2. The first piece 38 and second piece 40 of the post clamp 34 fit around the outside of the post 12. On one end, the first piece 38 and the second piece 40 interconnect in a releasable hinge 42. The male end of the second piece 40 fits within the female end of the first piece 38, to form the releasable hinge 42. The rail clamp 50 fits around the outside of the rail 16 (an end rail in this case, however, the process is identical for open rails). Then the threaded bolt 46 fits through the holes 52 in the rail clamp 50 and the holes 36 in the first piece 38 and second piece 40 of the post clamp 34. The nut 48 secures to the bolt 46, and allows for application of a variable clamping force to secure the post 12 and rail 16.

Figure 5B:
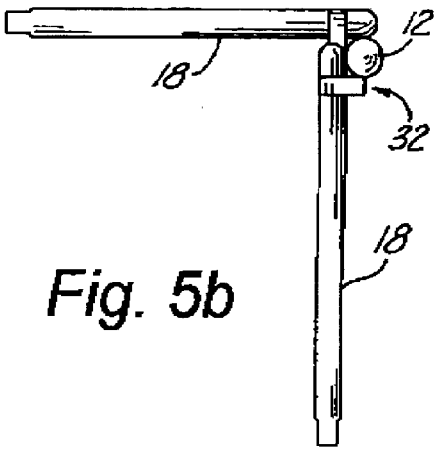
FIG. 5*b* shows a top plan view of an inside corner of the post and rail fence.
Figure 5A:
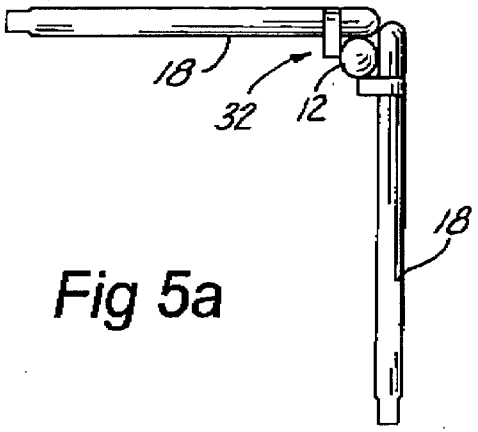
FIG. 5*a* shows a top plan view of an outside corner of the post and rail fence.

FIG. 5*a–b* show two arrangements for the corners of the fence 10. In FIG. 5*a*, the clamps 32 securing the rails 18 pivot such that the rails 18 are outside the post 12. In FIG. 5*b*, the clamps 32 securing the rails 18 pivot such that the rails 18 are inside the post 12. Either configuration is acceptable.

The posts 12 are constructed from 11 gauge steel pipe 2 ⅜" in diameter, and come in heights of 5½', 6½', 8', or 9' depending on the application. The rails 16 are constructed of 16 gauge steel pipe with an outer diameter that varies between 2⅜", 1.9", to 1.66". The open rails are 12' in length, and the end rails 18, 20 are either 12' or 6'. The clamps 32 are constructed of steel strap material, wherein the rail clamps 50 are sized to fit over the outer diameter of the rails 16 and the post clamps 34 are sized to fit over the outer diameter of the posts 12. All the components of the fence 10 include a wear resistant and corrosion resistant baked on powder coat finish. The finish presents a polished smooth appearance, and comes in a variety of colors that virtually eliminates the need for painting and other periodic maintenance required in prior art fencing.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

I claim:

1. A ground supported post and rail fence, said fence comprising:

a) a plurality of posts rigidly engaged with the ground, and spaced apart at convenient intervals;

b) a plurality of rails;

c) a plurality of clamps wherein said clamps interconnect said posts and said rails; and d) wherein said clamps comprise a post clamp for clamping said posts comprising a first and a second piece that interconnect on one end with a releasable hinge, a rail clamp for clamping said rails, and a tensioning member for interconnecting said first and said second piece of said post clamps at an end opposite to said end with said releasable hinge and for interconnecting said post and rail clamps and for providing a variable clamping force to said post and rail clamps to maintain said interconnection between said posts and said rails.

2. The invention in accordance with claim 1 wherein said rail clamp comprises a strap formed to fit around an outside of said rails.

3. The invention in accordance with claim 1 wherein said post clamp comprises a strap formed to fit around an outside of said posts.

4. The invention in accordance with claim 1 wherein said rails are generally parallel to the ground.

5. The invention in accordance with claim 1 wherein said rail clamp comprises a strap formed to fit around an outside of said rails comprising aligned holes, said first piece of said post clamp has a first hole and said second piece of said post clamp has a second hole such that on said end opposite to said end with said releasable hinge said first piece and said second piece of said post clamp interconnect by aligning said first and second holes to form a strap that fits around an outside of said posts, wherein said tensioning member interconnects said rail clamp and said post clamp through said aligned holes and said first and said second holes.

6. The invention in accordance with claim 5 wherein said tensioning member comprises a threaded bolt and nut that passes through said aligned holes in said rail clamp and said first and said second holes in said post clamp.

7. The invention in accordance with claim 1 wherein said rail clamp pivots relative to said post clamp about said tensioning member.

8. The invention in accordance with claim 1 wherein said plurality of rails includes end rails and open rails, wherein said end rails comprise an open end and a closed end and said open rails comprise open ends.

9. The invention in accordance with claim 8 wherein said end rails are positioned at the ends of each fence section, and said open rails are positioned therebetween.

10. The invention in accordance with claim 8 wherein said open rails include a tapered end to allow for swaged interconnection with said open end of an adjoining rail.

11. The invention in accordance with claim 8 further comprising end rails of a first length and end rails of a second length less than said first length, wherein said plurality of rails are arranged in at least two generally parallel rows such that one row begins with said end rail of said first length and another row begins with said end rail of said second length thereby staggering interconnection points of said rails of said rows.

12. A ground supported post and rail fence, said fence comprising:

a) a plurality of posts rigidly engaged with, and generally vertical to, the ground, and spaced apart at convenient intervals;

b) a plurality of end rails of a first length having an open end and a closed end, for positioning at the ends of each fence section;

c) a plurality of end rails of a second length having an open end and a closed end, for positioning at the ends of each fence section;

d) a plurality of open rails having an open end and a tapered end to allow for swaged interconnection with an open end of an adjoining rail, and positioned between said end rails;

e) wherein said plurality of rails are arranged in at least two generally parallel rows such that one row begins with said end rail of said first length and another row begins with said end rail of said second length thereby staggering interconnection points of said rails of said rows;

f) a plurality of clamps wherein said clamps interconnect said posts and said rails such that said rails are generally parallel to the ground, wherein said clamps further comprise:

i) a post clamp comprised of a first piece with a hole and a second piece with a hole such that said first and second pieces interconnect on one end with a releasable hinge;

ii) a rail clamp for clamping said rails comprised of a strap with aligned holes formed to fit around the outside of said rails; and iii) a threaded bolt and nut for interconnecting said first and second pieces of said post clamp on an end opposite to said releasable hinge and said rail clamp through said holes in said rail clamp and in said first and second piece of said post clamp, and for providing a variable clamping force to maintain said interconnection between said posts and said rails, wherein said rail clamp pivots relative to said post clamp about said bolt.

* * * * *